US006314755B1

(12) United States Patent
Schoenecker et al.

(10) Patent No.: US 6,314,755 B1
(45) Date of Patent: Nov. 13, 2001

(54) DOUBLE COLUMN SYSTEM FOR THE LOW-TEMPERATURE FRACTIONATION OF AIR

(75) Inventors: Herbert Schoenecker, Ebenhausen; Jurgen Voit, Schondorf, both of (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/513,176

(22) Filed: Feb. 25, 2000

(30) Foreign Application Priority Data

Feb. 26, 1999 (DE) ..... 199 08 451

(51) Int. Cl.[7] ..... F25J 3/00
(52) U.S. Cl. ..... 62/643; 62/651
(58) Field of Search ..... 62/643, 645, 646, 62/651

(56) References Cited

U.S. PATENT DOCUMENTS 4,555,256 11/1985 Skolaude et al. .
4,964,901 * 10/1990 Rhode ..... 62/646
5,037,462 * 8/1991 Schweigert ..... 62/646
5,379,598 * 1/1995 Mostello ..... 62/646

FOREIGN PATENT DOCUMENTS 38 14 187 A1 11/1989 (DE) .
0 446 004 A1 9/1991 (EP) .
0 810 412 A2 12/1997 (EP) .

* cited by examiner

*Primary Examiner*—Ronald Capossela
(74) *Attorney, Agent, or Firm*—Millen, White, Zelano & Branigan, P.C.

(57) ABSTRACT

The process and the apparatus serve for the low-temperature fractionation of air in a rectification system that has at least one pressure column and one low-pressure column. Feed air is compressed to a first pressure $p_1$ in a first compressor, purified in a purification stage, cooled and at least in part introduced into the pressure column. At least one liquid fraction from the pressure column is fed into the low-pressure column. A nitrogen-rich fraction from the low-pressure column is warmed and mixed with feed air. The warmed nitrogen-rich fraction is mixed with the feed air downstream of the feed air purification stage. The mixture of feed air and nitrogen-rich fraction is further compressed in a second compressor to a second pressure $p_2$ which is higher than the first pressure $p_1$.

11 Claims, 1 Drawing Sheet

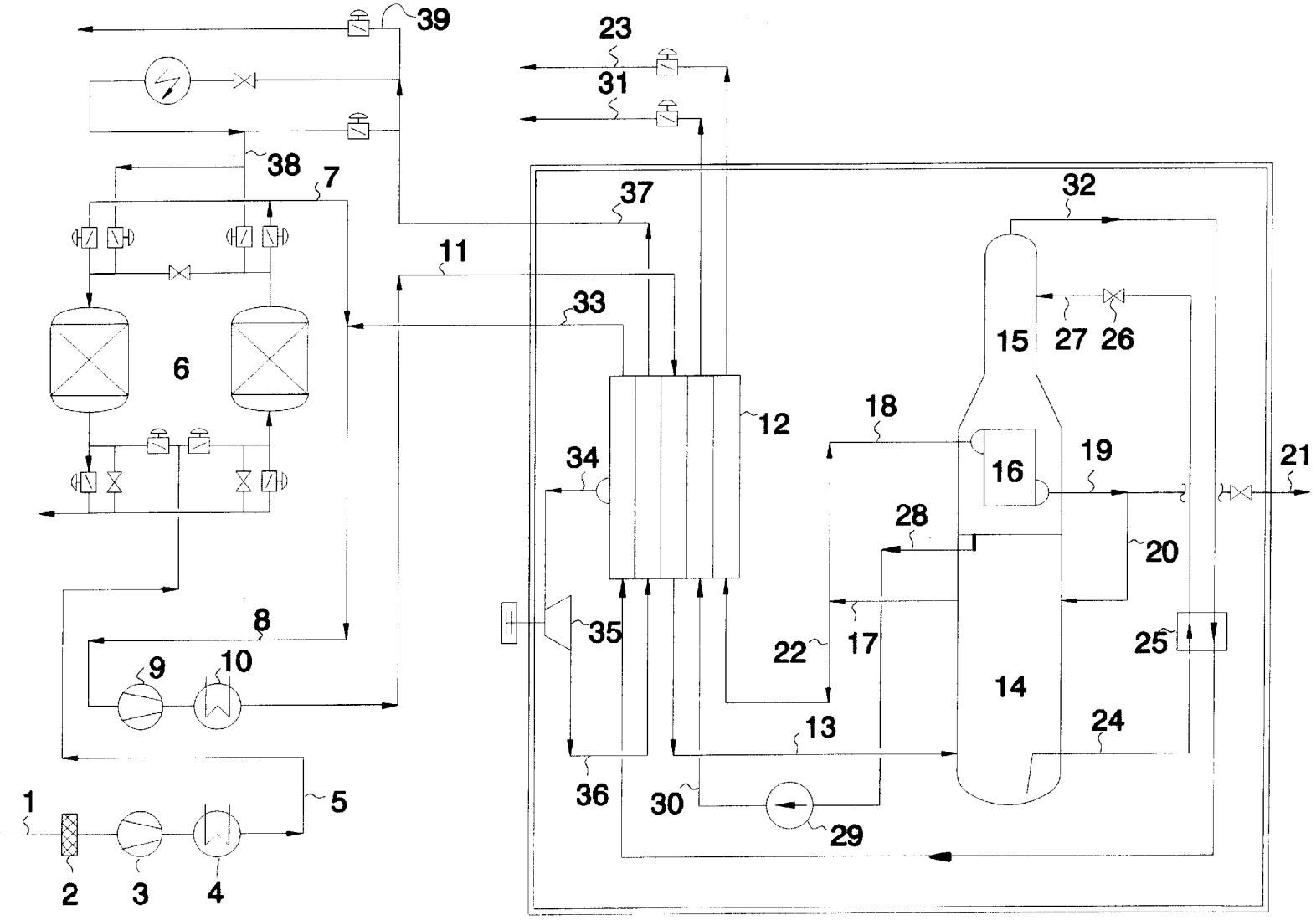
1
2
3
4
5
6
7
8
9
10
11
12
13
14
15
16
17
18
19
20
21
22
23
24
25
26
27
28
29
30
31
32
33
34
35
36
37
38
39

DOUBLE COLUMN SYSTEM FOR THE LOW-TEMPERATURE FRACTIONATION OF AIR

FIELD OF THE INVENTION

The invention relates to a process for the low-temperature fractionation of air and particularly to a low-temperature fractionation including at least one pressure column and at least one compressor.

BACKGROUND OF THE INVENTION

A process of low-temperature fractionation and a corresponding apparatus are disclosed by EP 810412A. There, the nitrogen-rich fraction is recompressed by means of a compressor prior to its mixing.

Another process is disclosed by DE-38 14 187-C2. Here, impure nitrogen from an intermediate point from the low-pressure column is recycled upstream of the first stage of the air compressor. Still another process is shown in U.S. Pat. No. 4,848,996, where the impure nitrogen is taken off at the top of the low-pressure column and the feed air is added at an intermediate stage of the air compressor.

Recycling the nitrogen-rich fraction into the feed air is advantageous per se and increases the product yield. Nevertheless, the process can be improved.

SUMMARY OF THE INVENTION

One feature of the invention is a process and a corresponding apparatus for low-temperature air fractionation which are particularly expedient economically and, in particular, require relatively low capital costs.

This feature is achieved by the fact that the mixture of feed air and nitrogen-rich fraction is further compressed in a second compressor to a second pressure $p_2$ which is higher than the first pressure $P_1$.

In this manner the expenditure on compression of the feed air and on recompression of the nitrogen-rich fraction is kept comparatively small by, desirably, only compressing the feed air at the first compressor rather than a combination of the feed air and nitrogen-rich fraction. The first and second compressors can be of a single- or multistage design. They can be driven independently of one another or be coupled to one another via a shared shaft or a gear. Preferably, the first pressure $p_1$ is near the operating pressure of the low-pressure column, that is to say the difference between the two said pressures is no more than about 0.5 bar.

Preferred ranges of values for the outlet pressures of the two compressors are:

first compressor ($p_1$): about 2 to about 12 bar, preferably about 3 to about 4 bar second compressor ($p_2$): about 6 to about 40 bar, preferably about 9 to about 13 bar.

The specific values depend in the individual case on the desired delivery pressure of the product or one of the products (for example nitrogen) which are generated in the gaseous state in one of the columns, or on the pressure of one or more product streams (oxygen and/or nitrogen) which are withdrawn in the liquid state from one of the columns and, after pressure boosting, are vaporized in the liquid state at delivery pressure.

The "nitrogen-rich fraction" can be formed by pure nitrogen or by a mixture of atmospheric gases whose nitrogen content is, for example, greater than about 50 mol %. They can be taken off overhead or from an intermediate point of the low-pressure column.

It is expedient if the nitrogen-rich fraction is warmed at least in part by indirect heat exchange with the feed air, for example downstream of the second compressor.

The advantages of the process of the invention become noticeable particularly when a nitrogen fraction is withdrawn from the upper region of the pressure column, warmed and taken off as pressurized nitrogen product. The expedient form of the recycling of a nitrogen-rich fraction from the low-pressure column into the feed air effects a particularly high yield of pressurized nitrogen product with relatively low equipment cost.

Cold can be generated in the process by work-expansion of a further nitrogen-rich fraction from the low-pressure column. This can be taken off, for example, from the upper region, for example from the top, of the low-pressure column. It is expedient if the nitrogen-rich fraction to be recycled and the nitrogen-rich fraction to be work-expanded are taken off from the low-pressure column and, if appropriate, warmed, together. The further nitrogen-rich fraction can, for example, be separated off from the stream to be recycled at an intermediate temperature of the main heat exchanger for cooling feed air.

Alternatively or additionally, an oxygen-containing fraction from the lower region of the low-pressure column can be work-expanded, in particular in the same expansion machine. For this purpose an oxygen-containing fraction is taken off, for example, from the bottom of the low-pressure column or from the vaporization space of the bottom of the boiler of the low-pressure column (main condenser), warmed in the main heat exchanger to an intermediate temperature and fed to an expansion machine. If, in addition, a further nitrogen-rich fraction is work-expanded, this is preferably mixed with the oxygen-containing fraction immediately upstream of the work-expansion and the two fractions to be expanded are introduced together into the same expansion machine (preferably expansion turbine).

The invention further relates to an apparatus for the low-temperature fractionation of air.

The process of the invention is particularly suitable for processes in which the operating pressure at the top of the pressure column is about 5.7 to about 29.7 bar, preferably about 8.7 to about 12.7 bar, and the operating pressure at the top of the low-pressure column is about 1.8 to about 11.8 bar, preferably about 2.8 to about 3.8 bar. Process cold can be generated in the process by work-expansion of a process stream. It is expedient in this case to expand a residual gas stream from the low-pressure column which is taken off, for example, together with the nitrogen-rich fraction from the low-pressure column, warmed to an intermediate temperature and fed to an expansion machine.

The invention and further details of the invention are described in more detail below with reference to an exemplary embodiment shown in the drawing.

Atmospheric air 1 is taken in via a filter 2 by a first compressor 3 and compressed to a pressure $p_1$ of about 3 bar. After removing the heat of compression in an aftercooler 4, the air 5 is fed to a purification stage 6 which, in the example, is formed by a pair of switchable molecular sieve absorbers. In the purification stage 6, in particular carbon dioxide and water are removed from the feed air. The purified feed air flows via the lines 7 and 8 to a second compressor 9 which brings it to a pressure $p_2$ of about 9bar. Again the heat of compression is removed in an aftercooler 10. The highly compressed feed air 11 is cooled in a main heat exchanger 12 to about dewpoint and partly liquefied and finally completely fed via line 13 to the pressure column 14 of a double-column rectification system that in addition has a low-pressure column 15. Pressure column 14 and low-pressure column 15 are in heat-exchange connection via a shared condenser-evaporator (main condenser) 16. The exemplary operating pressures (in each case at the top) are about 8.7 bar in the pressure column 14 and about 2.8 bar in the low-pressure column 15.

A first part 18 of the overhead nitrogen 17 of the pressure column 14 is fed via line 18 to the main condenser 16 and is there at least partly, preferably essentially completely, condensed against vaporizing bottoms liquid of the low-pressure column 15. The condensate 19 produced in this way is delivered at least in part as reflux via line 20 to the pressure column 14. (Optionally, a portion can be fed to an internal compression, by bringing it in the liquid state to an elevated pressure and then vaporizing it against feed air; this variant is not shown in the drawing.) If needed, a part of the condensate 18 can be produced as liquid nitrogen product 21. A further part of the gaseous pressure-column nitrogen 17 is fed via line 22 to the main heat exchanger 12, warmed there to about ambient temperature and finally taken off as pressurized nitrogen product 23.

From the lower region of the pressure column 14, preferably from the bottom, liquid crude oxygen 24 is taken off, subcooled in a countercurrent flow heat exchanger 25, expanded (26) and introduced (27) into the low-pressure column 15, which in the example is constructed as a pure stripping column. Liquid oxygen 28 is withdrawn as main product from the low-pressure column 15 at the bottom, brought by means of a pump 29 to an elevated pressure of, for example, 30 bar and vaporized and warmed against feed air 11. The oxygen vaporization in the example takes place in the main heat exchanger 12. The oxygen is finally removed as pressurized product via line 31.

Impure nitrogen 32 is withdrawn as a nitrogen-rich fraction at the top of the low-pressure column 15 and warmed in the countercurrent flow heat exchanger 25 and in the main heat exchanger 12. The nitrogen-rich fraction 33 which has been warmed to about ambient temperature is added to the purified feed air 7, and is fed together with this via line 8 to the second compressor 9 and further via the lines 11 and 13 to the pressure column 14.

A part 34 of the impure nitrogen taken off from the low-pressure column 15 via line 32 can be passed out of the main heat exchanger 12 at an intermediate temperature, work-expanded through an expansion machine 35 and passed via line 36 back to the main heat exchanger 12. The virtually unpressurized residual gas exits from the warm end of the main heat exchanger 12 via line 37. A first part 38 of the warmed unpressurized residual gas 37 can be used in the purification stage 6 as regeneration gas, while the remainder 39, in the example, is blown off to atmosphere.

The exemplary embodiment can easily be modified, for example to produce a more greatly enriched nitrogen product in the low-pressure column 15. For this purpose, above the infeed 27 of the crude oxygen, at least one further rectification section must be provided, at the top of which the nitrogen-rich fraction 32 is taken off. Using a further section above this impure nitrogen takeoff, pure oxygen can also be produced at the top of the low-pressure column 15. In both cases a part of the liquid nitrogen 19 from the main condenser 16 must be fed as reflux liquid to the low-pressure column 15.

Alternatively or additionally to the pressurized oxygen production by means of internal compression which is shown, gaseous oxygen can be withdrawn as product directly above the bottom of the low-pressure column 15 or some plates above this; it is also possible to produce oxygen as liquid product from the bottom of the low-pressure column 15, for example via a takeoff from line 28 upstream of the pump 29.

In the foregoing and in the following examples, all temperatures are set forth uncorrected in degrees Celsius; and, unless otherwise indicated, all parts and percentages are by weight.

The entire disclosure of all applications, patents and publications, cited above and below, and of corresponding German Application No. 199 08 451.3, filed Feb. 26, 1999, is hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

Upon further study of the specification and appended claims, further features and advantages of this invention will become apparent to those skilled in the art.

What is claimed is:

1. A process for the low-temperature fractionation of air comprising:

compressing feed air to a first pressure $p_1$ in a first compressor;

purifying the compressed feed air in a purification stage for removal of at least $CO_2$;

cooling the purified feed air;

introducing at least a part of the cooled feed air into a high-pressure column;

introducing at least one liquid fraction from the high-pressure column into a low-pressure column;

recycling a nitrogen-rich fraction from the low-pressure column by mixing the nitrogen-rich fraction with the feed air after purifying but before cooling; and further compressing prior to cooling the mixture of feed air and the nitrogen-rich fraction in a second compressor to a second pressure $p_2$ which is higher than the first pressure $p_1$.

2. The process according to claim 1, further comprising warming the nitrogen-rich fraction at least in part by indirect heat exchange with feed air.

3. The process according to claim 1, further comprising withdrawing a nitrogen fraction from the upper region of the high-pressure column, warming and recovering as pressurized nitrogen product.

4. The process according to claim 1, further comprising work-expanding a further nitrogen-rich fraction from the low-pressure column.

5. The process according to claim 1, further comprising work-expanding an oxygen-containing fraction from the lower region of the low-pressure column.

6. An apparatus for the low-temperature fractionation of air with a rectification system comprising:

at least one high-pressure column in fluid communication with a low-pressure column;

a feed air line communicating with a first compressor, a purification stage, a second compressor, a main heat exchanger, and the high-pressure column; and a return line for a nitrogen-rich fraction from the low-pressure column communicating with the feed air line after the purification stage but prior to the second compressor wherein the first compressor is designated for the compression of feed air to a first pressure $p_1$ and the second compressor is designed for the compression of a mixture of the feed air and nitrogen-rich fraction to a second pressure $p_2$ which is higher than the first pressure $p_1$.

7. The apparatus for the low-temperature fractionation of air with a rectification system according to claim 6, wherein the return line is in communication with the top of the low-pressure column.

8. An apparatus according to claim 6, wherein the purification stage comprises a pair of switchable molecular sieve absorbers.

9. An apparatus for the low-temperature fractionation of air with a rectification system comprising:

at least one pressure column and a low-pressure column;

a feed air line communicating with a first compressor, and then with the pressure column; and a return line from the low-pressure column communicating with the feed air line downstream of the first compressor but upstream from a second compressor.

10. In a process for the low-temperature fractionation of air, the improvement comprising:

compressing feed air to a first pressure $P_1$ in a first compressor; and further compressing the feed air after mixing the feed air with a recycled nitrogen-rich fraction in a second compressor to a second pressure $p_2$ which is higher than the first pressure $p_1$.

11. In an apparatus for the low-temperature fractionation of air with a rectification system, the improvement comprising:

a feed air line communicating with a first compressor and a second compressor; wherein the first compressor is designed for compression of a feed air to a first pressure $p_1$ and the second compressor is designed for compression of a mixture of the feed air and a nitrogen-rich fraction recycled from a low-pressure column to a second pressure $p_2$ which is higher than the first pressure $p_1$.

* * * * *